US006929092B2

(12) United States Patent
Abe et al.

(10) Patent No.: US 6,929,092 B2
(45) Date of Patent: Aug. 16, 2005

(54) SPEAKER DIAPHRAGM

(75) Inventors: Yasuhisa Abe, Tendo (JP); Takashi Suzuki, Tendo (JP); Koji Matsumoto, Tendo (JP); Koji Takayama, Tendo (JP)

(73) Assignees: Pioneer Corporation, Tokyo (JP); Tohoku Pioneer Corporation, Yamagata-ken (JP)

( * ) Notice: Subject to any disclaimer, the term of this patent is extended or adjusted under 35 U.S.C. 154(b) by 321 days.

(21) Appl. No.: 09/973,073

(22) Filed: Oct. 10, 2001

(65) Prior Publication Data

US 2002/0046900 A1 Apr. 25, 2002

(30) Foreign Application Priority Data

Oct. 23, 2000 (JP) ..... 2000-322787

(51) Int. Cl.[7] ..... G10K 13/00
(52) U.S. Cl. ..... 181/168; 181/167

(58) Field of Search ..... 181/167, 168, 181/157, 160, 161, 182, 181, 180, 166, 169, 170, 171, 172

(56) References Cited

U.S. PATENT DOCUMENTS 4,351,411 A * 9/1982 Inoue ..... 181/168
4,461,930 A * 7/1984 Melillo et al. ..... 181/168
4,713,277 A * 12/1987 Akiyama et al. ..... 164/79
5,587,562 A * 12/1996 Sato ..... 181/167
5,903,658 A * 5/1999 Okazaki et al. ..... 381/428
5,933,508 A * 8/1999 Fuke et al. ..... 381/343

* cited by examiner

*Primary Examiner*—Kimberly Lockett
(74) *Attorney, Agent, or Firm*—Morgan, Lewis & Bockius LLP

(57) ABSTRACT

A speaker diaphragm that has a high heat-radiation efficiency. The speaker diaphragm includes a diaphragm main body made from a resin, and a metallic plate adhered to a major acoustic surface of the diaphragm main body adjacent a voice coil bobbin. The voice coil bobbin is attached to the diaphragm man body.

11 Claims, 2 Drawing Sheets

SPEAKER DIAPHRAGM

BACKGROUND OF THE INVENTION

1. Field of the Invention

The present invention relates to an electroacoustic transducer such as an electrodynamic loudspeaker, and more particularly to a diaphragm of a speaker.

2. Description of the Related Art

Referring to FIG. 1 of the accompanying drawings, illustrated is a partial cross sectional view of a conventional electrodynamic loudspeaker, which is one example of an electroacoustic transducer. The electrodynamic loudspeaker includes a pole yoke 1 projecting from a center portion of a back plate, and a magnet 2 placed around the pole yoke 1. A top plate 3 is placed on the magnet 2 such that a magnetic gap is created between the top plate 3 and pole yoke 1 to form a magnetic circuit. The top plate 3 is fixedly secured to a frame 5. A voice coil bobbin 4, having a voice coil 4*a* wound therearound, is positioned to oscillate in the magnetic gap and is supported by a damper 7. A cone-shaped diaphragm 8 is connected to the voice coil bobbin 4 at a center portion of the diaphragm, and a center cap 6 is provided at a truncated portion of the cone-shaped diaphragm 8. An upper opening periphery of the diaphragm 8 is supported by the frame 5 via an edge 9. A lead of the voice coil is connected to a terminal located on a lateral face of the frame 5 via a cable (Litz wire).

As described above, the electrodynamic speaker unit has the voice coil in the magnetic circuit, and causes the air to oscillate as an audio signal is input to the voice coil. An electromagnetic force generated according to Fleming's left hand rule activates the voice coil and in turn the diaphragm connected to the voice coil.

In general, the material of the speaker diaphragm should have a low density, large Young's modulus (high rigidity), certain internal loss and good environmental resistance. In recent times, attention has been given to fabricating a subwoofer (low tone or bass speaker) from a diaphragm made from a single resin material (raw material), and installation of the subwoofer in a vehicle.

A radiation efficiency of heat generated from the voice coil and transferred to a neck portion of the diaphragm is generally restricted (determined) by the material of the diaphragm, and improvement in the radiation efficiency depends upon physical characteristics of the resin material. Acoustic characteristics, of course, depend upon the physical characteristics of the resin material.

In addition, the diaphragm should be able to accept a large input and oscillate with a large amplitude if it is used for a subwoofer placed in a vehicle. In other words, the subwoofer is subjected to severe installation and operation conditions. Specifically, a great amount of current is supplied to the voice coil. Therefore, heat radiation efficiency should be improved and acoustic characteristics should be maintained.

SUMMARY OF THE INVENTION

In order to solve the above described problems, the present invention aims to provide a speaker diaphragm that possesses a high heat radiation efficiency.

According to one aspect of the present invention, there is provided a speaker diaphragm including a diaphragm main body made from a resin, and a metallic plate attached to a major acoustic surface of the diaphragm main body adjacent a voice coil bobbin. The coil bobbin is to be attached to the diaphragm main body.

The diaphragm main body may be molded by injection molding.

The metallic plate may include a plurality of elongated metallic elements that radially extend from the vicinity of the voice coil bobbin.

The diaphragm main body may have a recess portion to receive the metallic plate, and the metallic plate may be attached to the diaphragm main body by an adhesive.

The diaphragm main body may have one of a planar, dome and conical shape, and the voice coil bobbin may be firmly secured to a periphery of the diaphragm main body.

DETAILED DESCRIPTION OF THE INVENTION

An embodiment of the present invention will be described in reference to the accompanying drawings.

Figure 2:
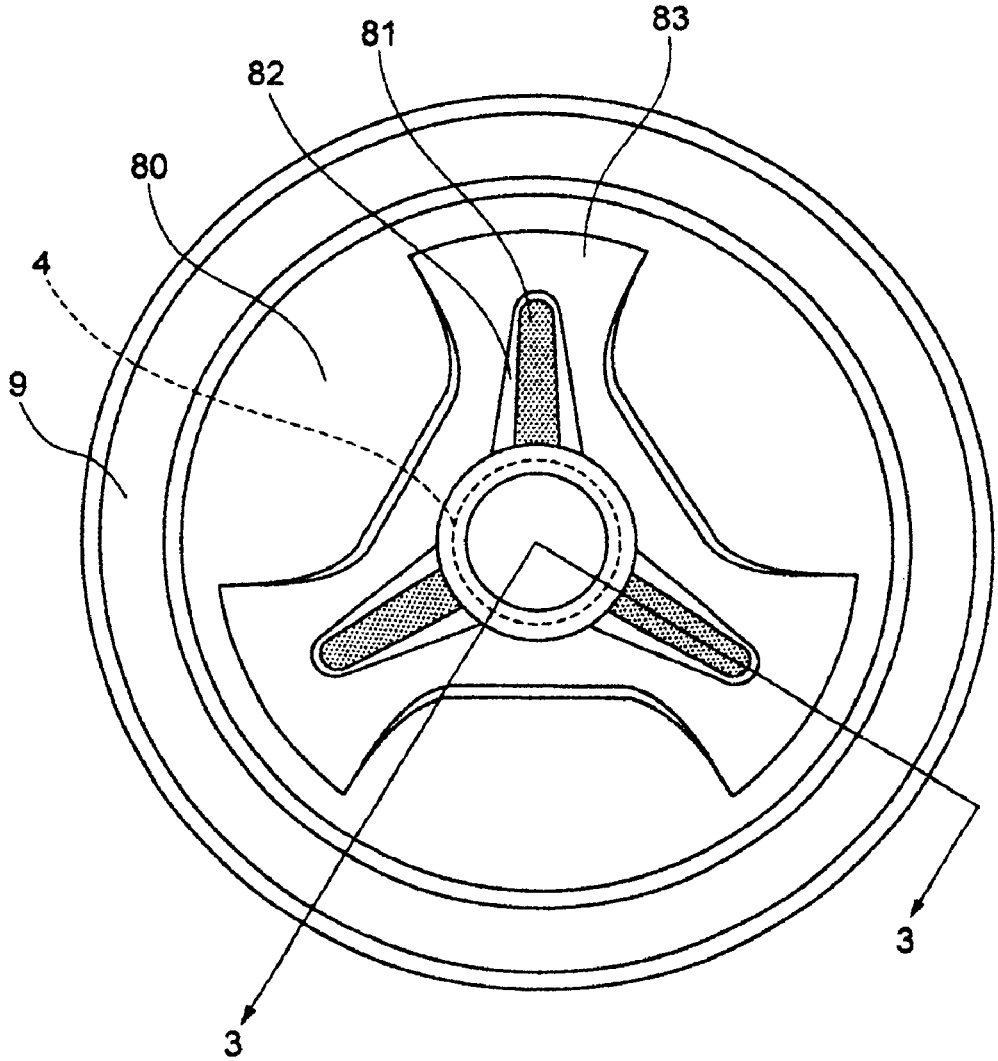
FIG. 2 illustrates a front view of a speaker diaphragm according to an embodiment of the present invention.

Referring first to FIG. 2, illustrated is an example of a speaker diaphragm, which is made by resin injection molding, according to the present invention.

This speaker diaphragm includes a diaphragm main body 80 and an edge 9 around the outer periphery of the main body 80. The diaphragm main body 80 is molded by an injection molding process using a resin such as PP (polypropylene). The speaker diaphragm also includes a metallic plate 81 of about 1 mm thickness. The metallic plate 81 may be made from aluminum or an aluminum alloy, and attached to the main acoustic side of the diaphragm main body 80 adjacent a voice coil bobbin 4. The voice coil bobbin 4 is attached to the diaphragm main body 80. The metallic plate 81 serves as heat radiation fins so that heat transferred to a neck portion of the diaphragm main body 80, which firmly supports the voice coil bobbin 4, is radiated from the radiation fins.

The metallic plate 81 includes, for example, three elongated metallic strips, which radially extend from the vicinity of the voice coil bobbin 4. The voice coil bobbin 4 is secured to the inner periphery of the metallic plate 81. In FIG. 2, each of the elongated metallic strips 81 is shaped like a sword, but it may have a rectangular shape. By changing the number, locations and shapes of the (individual) elongated metallic strips 81, it is possible to change the acoustic characteristics of the speaker, such as a frequency characteristic.

Figure 1:
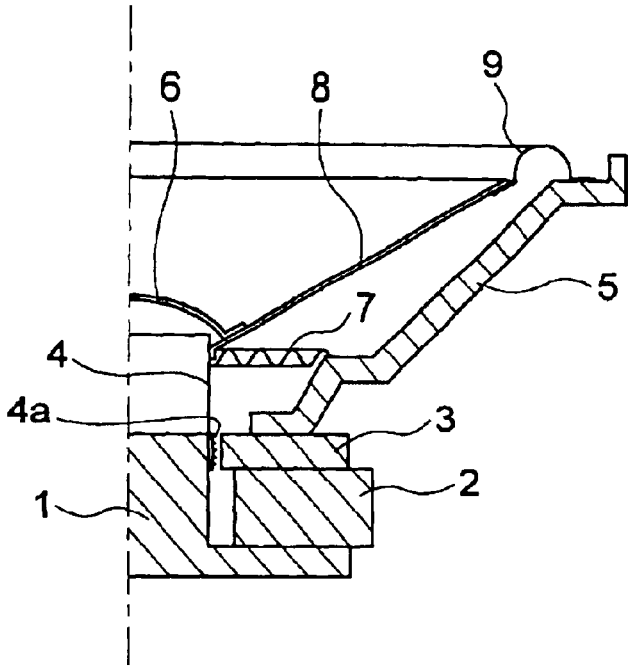
FIG. 1 illustrates a schematic partial cross sectional view of an electrodynamic speaker.
Figure 3:
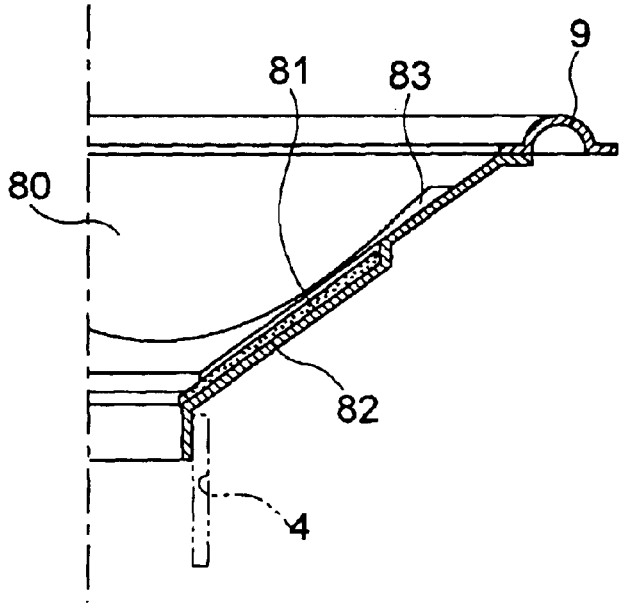
FIG. 3 illustrates a schematic partial cross sectional view taken along the line 3—3 in FIG. 2.

Referring to FIG. 3, the diaphragm main body has a recess portion 82, which is made by an injection molding process, to receive the metallic plate 81. The metallic plate 81 is attached to the recess portion by an adhesive. This arrangement allows a flux-type adhesive to sufficiently reach, i.e., expand to, the periphery of the metallic plate 81, and results in firm adhesion (fixation) of the metallic plate.

Although the diaphragm main body has a conical shape and includes a projecting embossment 83 on the acoustic side in the illustrated embodiment (FIGS. 2 and 3), it may have a planar shape or dome shape. In this case, the voice coil bobbin may be firmly secured to the inner or outer periphery of the planar or dome-shaped main body of the diaphragm.

The diaphragm main body may be fabricated by an injection molding machine using a resin material such as PP (polypropylene) in this embodiment.

More preferably, the diaphragm main body is made by an injection and foam molding process. The material for the injection and foam molding process may be PP containing a foaming agent. This diaphragm main body will have a three-layer structure, i.e., a foam layer as its inner portion and non-foam layers as its outer (or surface) layers. The resin contains a non-organic or organic filler of 3 to 30 wt %.

The speaker diaphragm is made by the injection and foam molding process that includes the step of injecting a resin-mixed material (PP plus a foaming agent) into a metallic mold, and immediately retracting the metallic mold to cause the foaming so as to create a foam layer in the inner portion. The surfaces of the material are solidified prior to the foaming since they contact the inner wall of the metallic mold during the resin filling step. Accordingly, the resulting structure is a three-layer structure having two non-foamed layers. As mentioned above, the resin-mixed material includes the non-organic or organic filler in the amount of 3 to 30 wt %. The filler causes the non-foamed surface layers to be porous and/or concavo-convex if its amount is too small. This deteriorates the appearance. If too much filler is included, it adversely affects the foaming condition and degrades the rigidity. Experimentally, the optimum amount of the filler is between 3 and 30 wt %.

As described above, the speaker diaphragm of the present invention includes a diaphragm main body made from a resin, and a metallic plate attached to a major acoustic surface of the diaphragm main body adjacent a voice coil bobbin, which is to be attached to the diaphragm main body. An electrodynamic speaker that includes this speaker diaphragm can maintain originally designed (intended) acoustic characteristics on one hand and raise a heat radiation efficiency on the other hand.

The illustrated and described speaker diaphragm is disclosed in Japanese Patent Application No. 2000-322787, the instant application is based on this Japanese Patent Application, and the entire disclosure thereof is incorporated herein by reference.

What is claimed is:

1. A speaker diaphragm arrangement comprising:

a voice coil bobbin;

a voice coil wound around the voice coil bobbin;

a diaphragm supported by the voice coil bobbin; and a separately-provided heat radiation member attached to a heat radiating side of the diaphragm for radiating heat generated in the voice coil, voice coil bobbin and diaphragm.

2. The speaker diaphragm arrangement according to claim 1, wherein the diaphragm is molded by injection molding.

3. The speaker diaphragm arrangement according to claim 2, wherein the metallic plate includes at least one elongated metallic element that radially extends proximally from the voice coil bobbin.

4. The speaker diaphragm arrangement according to claim 2, wherein the diaphragm has a recess portion to receive the metallic plate.

5. The speaker diaphragm arrangement according to claim 1, wherein the diaphragm has one of a planar, dome and conical shape.

6. The speaker diaphragm arrangement according to claim 2, wherein the metallic plate does not cover all of the heat radiating side of the diaphragm.

7. The speaker diaphragm arrangement according to claim 1, wherein the heat radiation member is a metallic plate.

8. A speaker diaphragm arrangement comprising:

a voice coil bobbin;

a voice coil wound around the voice coil bobbin;

a diaphragm supported by the voice coil bobbin;

an edge portion around the outer periphery of the diaphragm;

a heat radiation member attached to a main acoustic side of the diaphragm adjacent to, and extending radially from, the voice coil bobbin in a direction towards the edge portion, wherein the heat radiation member allows for radiation of heat generated in the voice coil, voice coil bobbin and diaphragm.

9. The speaker diaphragm arrangement according to claim 8, wherein the heat radiation member is a metallic plate.

10. The speaker diaphragm arrangement according to claim 9, wherein the metallic plate includes a plurality of elongated metallic elements that radially extend proximally from the voice coil bobbin in a direction towards the edge portion.

11. The speaker diaphragm arrangement according to claim 10, wherein the acoustic characteristics of the speaker diaphragm can be controlled by the arrangement of the plurality of elongated metallic elements.

* * * * *